US007036680B1

(12) United States Patent
Flannery

(10) Patent No.: US 7,036,680 B1
(45) Date of Patent: May 2, 2006

(54) DEVICE FOR DISPENSING PLASTIC FASTENERS

(75) Inventor: Steven E. Flannery, Wayland, MA (US)

(73) Assignee: Avery Dennison Corporation, Pasadena, CA (US)

( * ) Notice: Subject to any disclaimer, the term of this patent is extended or adjusted under 35 U.S.C. 154(b) by 175 days.

(21) Appl. No.: 10/819,475

(22) Filed: Apr. 7, 2004

(51) Int. Cl.
*B65H 5/28* (2006.01)

(52) U.S. Cl. ..... 221/74; 221/70; 227/67

(58) Field of Classification Search ..... 221/74, 221/70, 213; 227/67, 71
See application file for complete search history.

(56) References Cited

U.S. PATENT DOCUMENTS 4,023,722 A * 5/1977 Grushon ..... 227/25
4,039,078 A 8/1977 Bone
4,790,225 A * 12/1988 Moody et al. ..... 83/100
5,433,366 A 7/1995 Deschenes et al.
5,615,816 A 4/1997 Deschenes et al.
6,698,641 B1 3/2004 Flannery et al.

* cited by examiner

*Primary Examiner*—Khoi H. Tran
(74) *Attorney, Agent, or Firm*—Kriegsman & Kriegsman

(57) ABSTRACT

A device for dispensing an individual plastic fastener from a supply of fastener stock to couple together two or more objects. The supply of fastener stock includes a plurality of equidistantly spaced cross links which are coupled at one end to a continuous side rail. The fastener dispensing device includes a hollowed sharpened needle shaped to define a longitudinal bore and a feed mechanism for advancing the continuous side rail of the fastener stock into direct axial alignment behind the longitudinal bore of the hollowed needle. The feed mechanism includes a rotatably mounted feed shaft, a pair of feed wheels fixedly mounted on the feed shaft, each feed wheel comprising a plurality of sprockets which are sized and shaped to engage the supply of fastener stock, and first and second clutch wheels which are releasably matingly engageable with one another, the first clutch wheel being fixedly mounted on the feed shaft and the second clutch wheel being rotatably mounted on the feed shaft, each of the first and second clutch wheels including a plurality of ratchets. As a feature of the invention, the number of ratchets on each clutch wheel is at most equal to the number of sprockets on each feed wheel.

28 Claims, 10 Drawing Sheets

DEVICE FOR DISPENSING PLASTIC FASTENERS

BACKGROUND OF THE INVENTION

The present invention relates generally to plastic fasteners and more particularly to devices used in the dispensing of plastic fasteners.

In U.S. Pat. No. 4,039,078 to A. R. Bone, which is incorporated herein by reference, there are disclosed several different types of plastic fasteners (also commonly referred to in the art as plastic attachments). Each plastic fastener described in the patent is manufactured in an H-shaped configuration, with two shortened parallel cross-bars, or T-bars, being interconnected at their approximate midpoints by a thin, flexible filament which extends orthogonally therebetween. Each type of plastic fastener represented in the patent is shown as being fabricated as part of continuously connected ladder stock. In each instance, the ladder stock is formed from two elongated and continuous plastic side members, or rails, which are coupled together by a plurality of plastic cross links, or filaments, the cross links preferably being equidistantly spaced. The stock may be produced from flexible plastics material including nylon, polypropylene and other similar materials using conventional molding or stamping techniques. Ladder stock of the type described above is presently manufactured and sold by Avery Dennison™ Corporation of Pasadena, Calif. under the Plastic Staple™ and Elastic Staple™ lines of plastic fasteners.

Either manually or with the aid of specifically designed devices, individual fasteners may be severed and dispensed from a supply of ladder stock to couple buttons to fabric, merchandising tags to articles of commerce, or, in general, any two desired articles.

Specifically designed devices for dispensing plastic fasteners are well known in the art. One well-known device for dispensing individual plastic fasteners from a reel of ladder-type fastener stock includes a pair of hollow needles which are adapted to penetrate through a particular item, a feed mechanism for advancing each rail of the supply of ladder stock into axial alignment behind the longitudinal bore defined by a corresponding hollow needle, a severing mechanism for severing a fastener to be dispensed through the pair of hollowed needles from the remainder of the ladder stock, and an ejection mechanism for ejecting the cross-bars of the severed fastener through the bores of the pair of hollowed needles and, in turn, through the particular item which is penetrated by the needles.

For example, in commonly assigned U.S. Pat. No. 5,433,366, which is incorporated herein by reference, there is disclosed a device for dispensing plastic attachments of the type which are formed as part of a roll of continuously connected ladder stock. In one embodiment, the device includes a pair of hollow slotted needles each having a tip, a rear end and a longitudinal axis. A feed wheel, placed proximate to the rear ends of the pair of needles, is used to feed individual attachments of a roll of ladder stock into the pair of needles through their respective rear ends at angles relative to the longitudinal axes thereof. Once inserted into the needles, an attachment is severed from the remainder of the ladder stock by a knife and is then expelled from the needles by a pair of ejector rods movable along the longitudinal axes of the pair of needles. Because attachments are fed into the pair of needles at angles relative to their longitudinal axes, no shuttling of the needles between an attachment feeding position and an attachment ejecting position is required. The pair of needles, the feed wheel, the knife, and the pair of ejector rods are all mounted on a vertically movable head member. An electric motor assembly is used to move the head member between an attachment dispensing position and a withdrawal position. The vertical movement of the head member drives the operation of the feed wheel, the knife and the ejector rods.

Examples of some plastic fastener dispensing devices which are presently available in commerce are manufactured and sold by Avery Dennison™ Corporation of Pasadena, Calif. under the following names: the ST9000™, the Elastic Staple™ Single Needle System (SNS), the Elastic Staple™ Variable Needle System (VNS) and the Elastic Staple™ Single Needle System (SNS) Module.

As noted above, devices for dispensing plastic fasteners of the type described above are designed to cut the opposing rails of a supply of ladder stock at equidistant intervals to generate a plurality of individual plastic fasteners. The specific fixed distance, or spacing, between successive cuts in the rails of the ladder stock (i.e., the length of the cross-bar of each dispensed plastic fastener) is commonly referred to in the art as the pitch in which the device operates. As can be appreciated, each fastener dispensing device is typically designed to sever and eject plastic fasteners from a supply of ladder stock at a fixed pitch (e.g., at a pitch of ¼ of an inch).

Preferably, plastic fastener dispensing devices of the type described above are designed to sever the rails of the supply of ladder stock at the approximate midpoint between successive filaments. In this manner, each dispensed fastener is ensured of having H-type configuration, with each end of its thin filament secured to the approximate midpoint of an associated cross-bar.

However, it has been found that conventional plastic fastener dispensing devices often fail to sever the rails of the supply of ladder stock at the approximate midpoint between successive filaments. This failure to properly sever the rails of the supply of ladder stock at the approximate midpoint between successive filaments can be caused by, inter alia, manufacturing tolerances in the thickness of the rails and filaments of the ladder stock which, in turn, can create lag, or rubbing, of the ladder stock within feed tracks in the fastener dispensing device. The lag created between the ladder stock and the fastener dispensing device precludes the feed mechanism for the device from adequately advancing the lowermost fastener in the ladder stock to the appropriate stop position within the device prior to the cutting process. Because the ladder stock is inadequately advanced by the feed mechanism, the severing process cuts the rails of the ladder stock at a location other than at the midpoint between successive fasteners. As a result, the device will dispense plastic fasteners which fail to have each end of its filament accurately bisect a corresponding cross-bar, thereby compromising its ability to generate fasteners which have the optimal H-type configuration.

Accordingly, it is well-known for fastener dispensing devices to provide for both internal (i.e., factory set) and external (i.e., operator accessible) fine tune (i.e., micro) adjustments to its feed mechanism. Specifically, during the assembly of such a device, the manufacturer preferably calibrates the internal fine tune adjustment to its feed mechanism such that a supply of ladder stock will properly align within the device prior to the severing process. With the internal fine tune adjustment optimized for a supply of ladder stock having a particular pitch, a protective casing is mounted onto a support plate so as to enclose the majority of the mechanical components for the device (e.g., the internal fine tune adjustments). The device is then shipped to the customer for use. However, if the customer still finds that the feed mechanism for the device is not optimized to sever the rails of the ladder stock at the midpoint between successive filaments, the customer is allowed to further fine tune the feed mechanism by means of an additional adjustment means which is externally accessible. Similar to the internal fine tune adjustment, the external fine tune adjustment for the device can be used to ensure that the relative stop position of the lowermost fastener in the ladder stock prior to the severing process is such that the approximate midpoint between successive filaments is aligned directly with the sharpened edge of each knife blade for the severing mechanism.

Although well known and widely used in commerce, fastener dispensing devices which include internal and external fine tune adjustment means to its feed mechanism have been found to suffer from a notable drawback. Specifically, it has been found that the feed mechanism for such a device is typically factory-set to its optimal position (i.e., using its internal adjustment means). However, inexperienced users often introduce misalignment into the feed mechanism by manipulating its external adjustment means. As can be appreciated, the external adjustment means for calibrating the feed mechanism is extremely sensitive and requires a certain level of precision which is typically found with only the more experienced and methodical users. As a result, it has been found that, more often than not, the presence of an external adjustment means causes the user to introduce misalignment into the feed mechanism which is not present upon completion of its manufacture, which is highly undesirable.

SUMMARY OF THE INVENTION

It is an object of the present invention to provide a new and improved device for dispensing a plastic fastener from a supply of fastener stock, the fastener stock being shaped to include an elongated and continuous side rail to which are coupled a plurality of equidistantly spaced filaments.

It is another object of the present invention to provide a device as described above which is adapted to dispense a plastic fastener from the supply of fastener stock, the plastic fastener including a thin, flexible filament which is coupled at one end to the approximate midpoint of an orthogonally disposed cross-bar.

It is yet another object of the present invention to provide a device as described above which includes a sharpened needle shaped to define a longitudinal bore.

It is still another object of the present invention to provide a device as described above which includes a feed mechanism for advancing the side rail of the fastener stock into axial alignment behind the longitudinal bore defined by the hollow sharpened needle.

It is yet still another object of the present invention to provide a device as described above which includes a severing mechanism for cutting the side rail of the fastener stock at the approximate midpoint between successive filaments to separate a plastic fastener from the remainder of the fastener stock.

It is another object of the present invention to provide a device as described above which includes an ejection mechanism for ejecting the cross-bar of the severed plastic fastener through the bore defined by the hollow sharpened needle.

It is yet another object of the present invention to provide a device as described above which allows for the fine tune adjustment of the feed mechanism to ensure that the severing mechanism accurately cuts the side rail of the fastener stock at the approximate midpoint between successive filaments.

It is still another object of the present invention to provide a device as described above which limits the fine tune adjustment of the feed mechanism to factory set fine tune adjustment means located internally within a substantially enclosed casing for the device.

It is yet still another object of the present invention to provide a system as described above which has a limited number of parts, which is easy to use and which is inexpensive to manufacture.

Accordingly, there is provided a device for dispensing an individual fastener from a supply of fastener stock, the fastener stock being shaped to include a continuous side rail to which are coupled a plurality of equidistantly spaced cross links, the individual fastener including a filament coupled at one end to a cross-bar, the device comprising a hollowed needle shaped to define a longitudinal bore, a feed mechanism for advancing the continuous side rail of the fastener stock into direct axial alignment behind the longitudinal bore of the hollowed needle, the feed mechanism comprising, a rotatably mounted feed shaft, a feed wheel fixedly mounted on the feed shaft, the feed wheel comprising a plurality of sprockets which are sized and shaped to engage the supply of fastener stock, and first and second clutch wheels which are releasably matingly engageable with one another, the first clutch wheel being fixedly mounted on the feed shaft and the second clutch wheel being rotatably mounted on the feed shaft, each of the first and second clutch wheels including a plurality of ratchets, wherein the number of ratchets on each of the first and second clutch wheels is at most equal to the number of sprockets on the feed wheel, a severing mechanism adapted to cut the continuous side rail of the supply of ladder stock to yield the individual fastener, and an ejection mechanism for ejecting the cross-bar of the individual fastener axially through the longitudinal bore defined by the hollowed needle.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
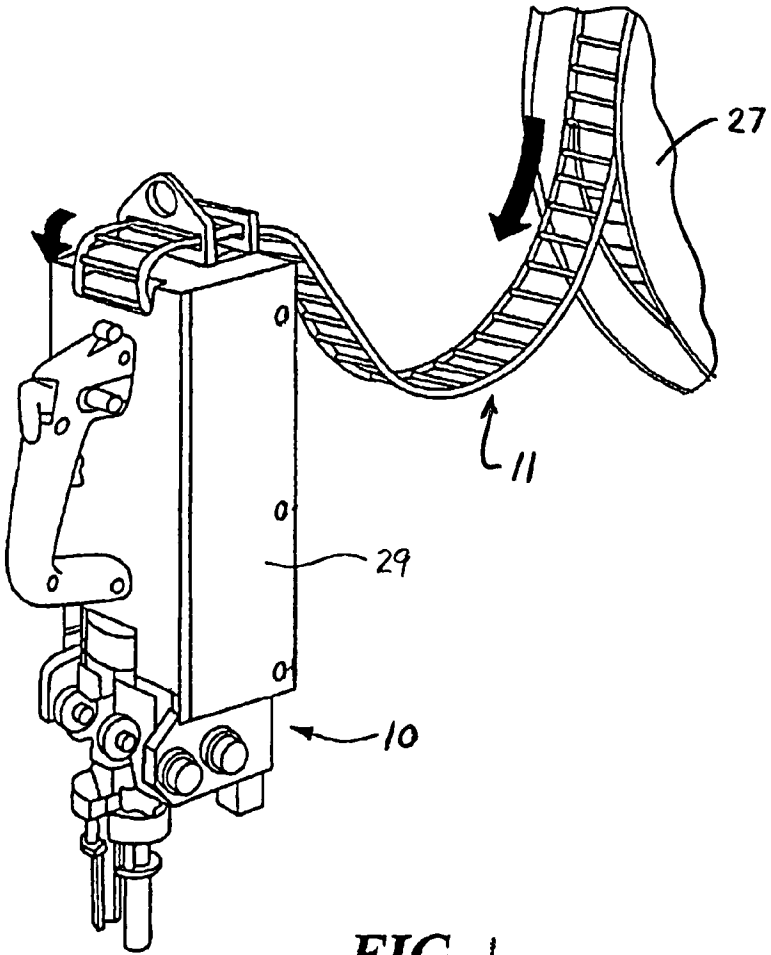
FIG. 1 PRIOR ART
FIG. 1 is a fragmentary, front, right side perspective view of a prior art fastener dispensing device which is shown with a supply of continuously connected ladder stock fed thereinto.
Figure 3:
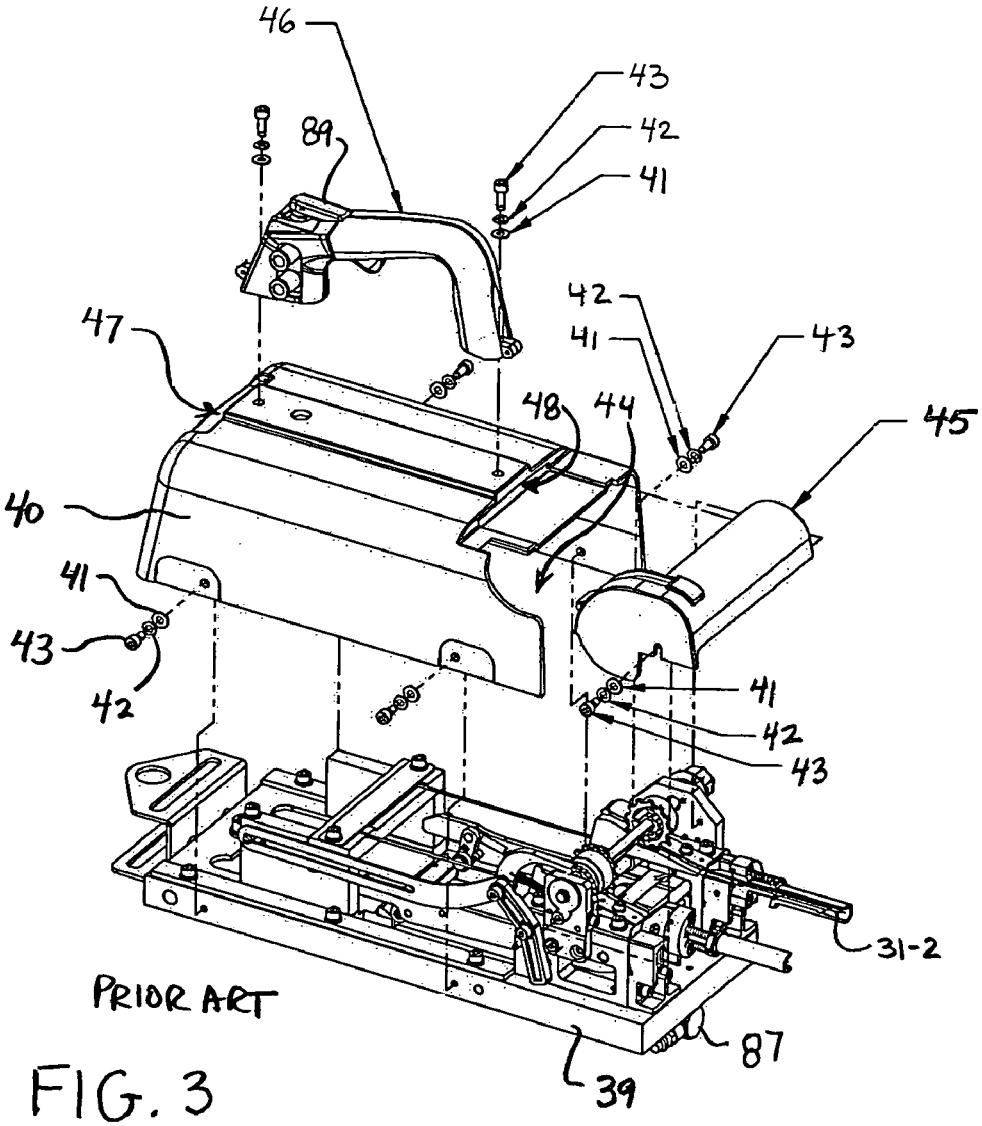
PRIOR ART FIG. 3
FIG. 3 is a partially exploded, front, left side perspective view of the prior art fastener dispensing device shown in FIG. 1.

Referring now to FIG. 1, there is shown a prior art device for dispensing individual plastic fasteners from a supply of continuously connected ladder stock, said device being identified generally by reference numeral 10 and said ladder stock being identified generally by reference numeral 11. As can be appreciated, device 10 can be used in an automated packaging line, for example, to secure together two or more products, such as socks, gloves, towels or other similar items, using one or more plastic fasteners from ladder stock 11.

Continuous Supply of Ladder Stock 11

Figure 2:
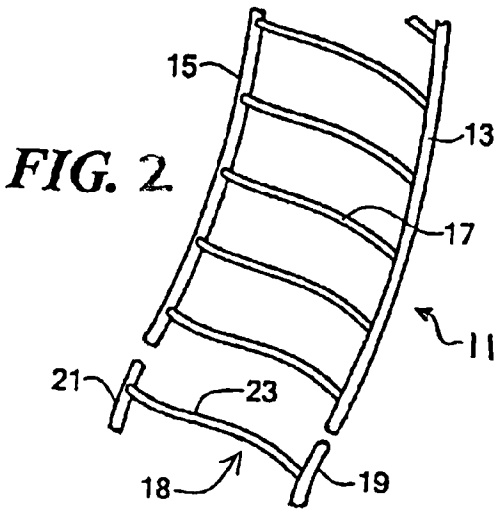
FIG. 2 PRIOR ART
FIG. 2 is an enlarged, fragmentary, front, right side perspective view of the supply of continuously connected ladder stock shown in FIG. 1.

Continuous supply of connected ladder stock 11 represents any well known continuous supply of plastic fasteners. For example, ladder stock 11 (also referred to herein as fastener stock 11) may be of the type described in U.S. Pat. No. 4,039,078 to A. R. Bone or of the type described in U.S. Pat. No. 5,615,816 to C. L. Deschenes et al., both of said patents being incorporated herein by reference. As an example, FIG. 2 shows a prior art length of continuously connected ladder stock 11 which may be used in device 10. Ladder stock 11 is preferably made of plastic and comprises a pair of elongated and continuous side members, or rails, 13 and 15 which are interconnected by a plurality of equidistantly spaced cross links 17.

An individual plastic fastener 18 is obtained from ladder stock 11 by severing side members 13 and 15 at the approximate midpoint between successive cross links 17. Fastener 18 comprises a pair of cross-bars 19 and 21 which are interconnected by a thin, flexible filament 23, cross-bars 19 and 21 comprising sections of side members 13 and 15, respectively, and filament 23 comprising a cross link 17.

It should be noted that the pitch for ladder stock 11 is commonly defined as the distance between successive cuts in each of side members 13 and 15 which is required to create plastic fastener 18 (i.e., the length of each of cross-bars 19 and 21). In addition, it should be noted that the pitch for ladder stock 11 is also defined as the distance between successive cross links 17.

It should be noted that, by severing side members 13 and 15 at the approximate midpoint between successive cross links 17, fastener 18 is provided with an H-shaped configuration, wherein opposing ends of filament 23 bisect corresponding cross-bars 19 and 21. As can be appreciated, it is typically preferred that prior art fastener 18 have an H-type configuration when used in its conventional application of coupling together two or more items.

Ladder stock 11 is preferably wound onto a reel 27, reel 27 being sized and shaped to hold a supply of ladder stock 11 which includes approximately 10,000 fasteners 18. As such, the high volume reel 27 of fasteners 18 enables device 10 to continuously dispense a large quantity of individual fasteners 18, which is highly desirable. High volume reels of plastic fasteners of the type described above are presently manufactured and sold by Avery Dennison™ Corporation of Pasadena, Calif. under the Plastic Staple® and Elastic Staples lines of plastic fasteners.

Prior Art Fastener Dispensing Device 10

Referring now to FIGS. 1 and 3–7, prior art fastener dispensing device 10 operates as a pneumatically-driven machine for dispensing individual plastic fasteners 18 from a supply of ladder stock 11. Fastener dispensing device 10 may be of the type disclosed in U.S. Pat. No. 6,698,641 to S. E. Flannery et al., which is incorporated herein by reference.

Device 10 includes a protective outer housing 29, a pair of hollowed needles 31-1 and 31-2 which are adapted to penetrate through the desired articles to be coupled together using fastener 18, a feed mechanism 33 for advancing side members 13 and 15 of ladder stock 11 into axial alignment behind the longitudinal bores defined by needles 31-1 and 31-2, respectively, a severing mechanism 35 for cutting side members 13 and 15 of ladder stock 11 at the approximate midpoint between successive cross links 17 to separate an individual plastic fastener 18 from the remainder of ladder stock 11, and an ejection mechanism 37 for ejecting cross-bars 19 and 21 of the severed plastic fastener 18 through needles 31-1 and 31-2, respectively, and in turn through the item to be coupled together by fastener 18.

Protective Housing 29 for Prior Art Device 10

Housing 29 is constructed of a rigid and durable material and serves to protect numerous internal components for device 10. As seen most clearly in FIG. 3, housing 29 comprises a substantially flat and rectangular base plate 39 which serves as the support, or foundation, on which numerous mechanical components in device 10 are mounted. Housing 29 also includes a cover 40 which is removably secured to base plate 39 at multiple locations using the combination of a washer 41, a lock washer 42 and a screw 43. Together, base plate 39 and cover 40 define a substantially enclosed internal cavity 44 in which the majority of the mechanical components for device 10 are disposed. Furthermore, housing 29 may additionally include a guard 45 which is removably secured to base 39 at multiple locations using the combination of a washer 41, lock washer 42 and a screw 43. In use, guard 45 serves to protect selected components for device 10 proximate needles 31.

A handle 46 is fixedly secured to the exterior of cover 40 at multiple locations using the combination of a washer 41, lock washer 42 and screw 43. Handle 46 allows the operator to freely manipulate device 10 in such a manner so as to penetrate the sharpened tips of needles 31 through the desired articles to be coupled together using one or more fasteners 18. In addition, upper and lower feed guide slots 47 and 48 are provided in cover 40, slots 47 and 48 enabling a substantial length of ladder stock 11 to pass through internal cavity 44 when properly fed into device 10, as seen most clearly in FIG. 1.

Figure 4:
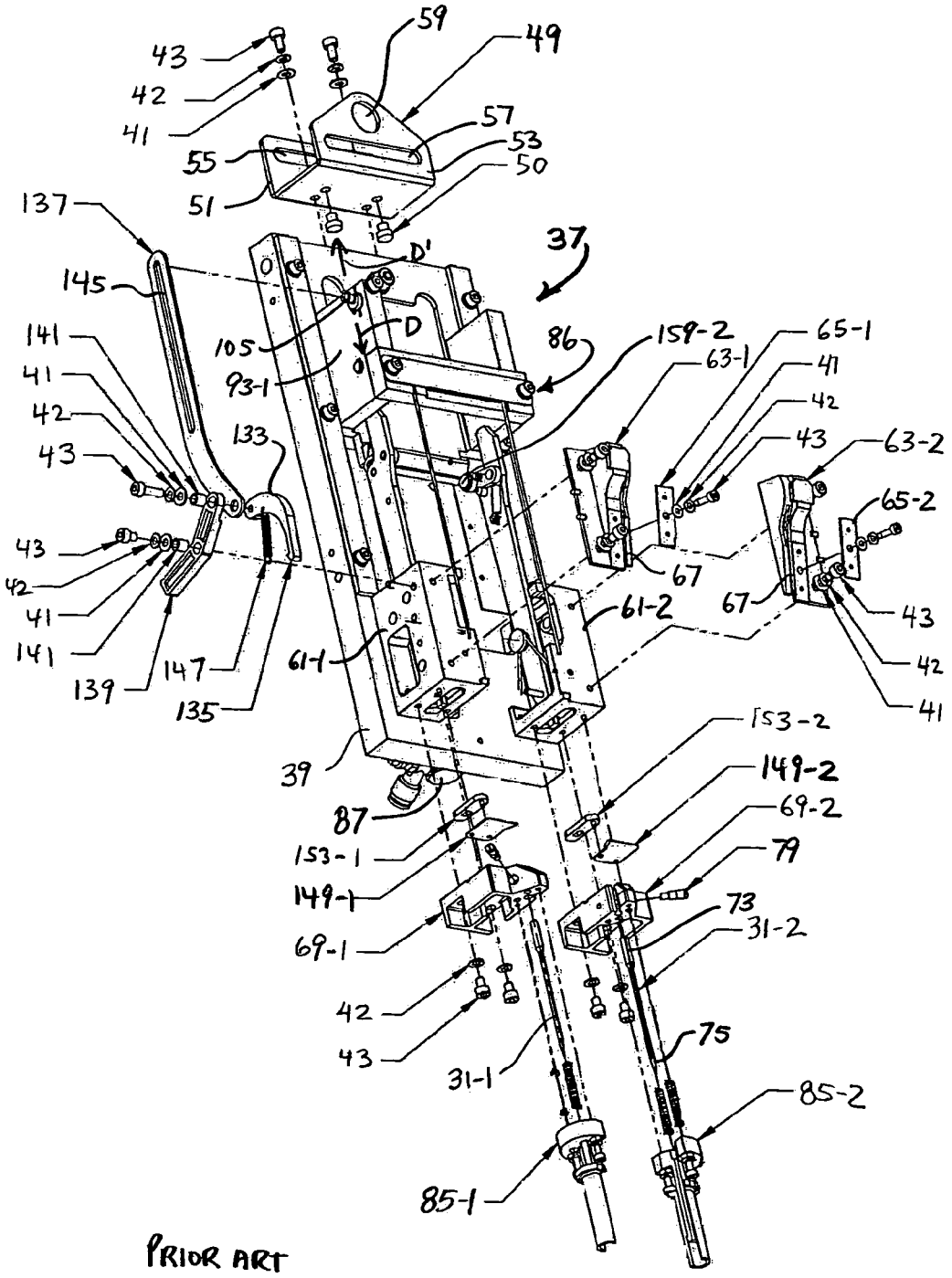
FIG. 4 is a partially exploded, front, left side perspective view of selected internal components of the fastener dispensing device shown in FIG. 1.

As seen most clearly in FIG. 4, a U-shaped bracket 49 is fixedly mounted on the top edge of base plate 39 at multiple locations using a washer 41, a lock washer 42 and a screw 43, bracket 49 being spaced slightly away from top edge of base plate 39 by a pair of cushions 50. Bracket 49 includes a first tab 51 and a second tab 53 which are disposed in a parallel, spaced apart configuration. First tab 51 of U-shaped bracket 49 extends perpendicularly away from the top of base plate 39 and is shaped to define an elongated feed slot 55. Second tab 53 of U-shaped bracket 49 similarly extends perpendicularly away from the top of base plate 39 and is shaped to include an elongated feed slot 57 and a clip opening 59.

As such, supply of fastener stock 11 is fed into device 10 in the following manner. Specifically, as seen most clearly in FIG. 1, the free end of fastener stock 11 is feed from reel 27, through feed slot 55 formed in first tab 51, through feed slot 57 formed in second tab 53, down into upper feed guide slot 47, through internal cavity 44 and out through lower feed guide slot 48. As will be described further below, the free end of ladder stock 11 which exits lower feed guide slot 48 is designed to be fed into axial alignment behind needles 31.

Needles 31 for Prior Art Device 10

Figure 7:
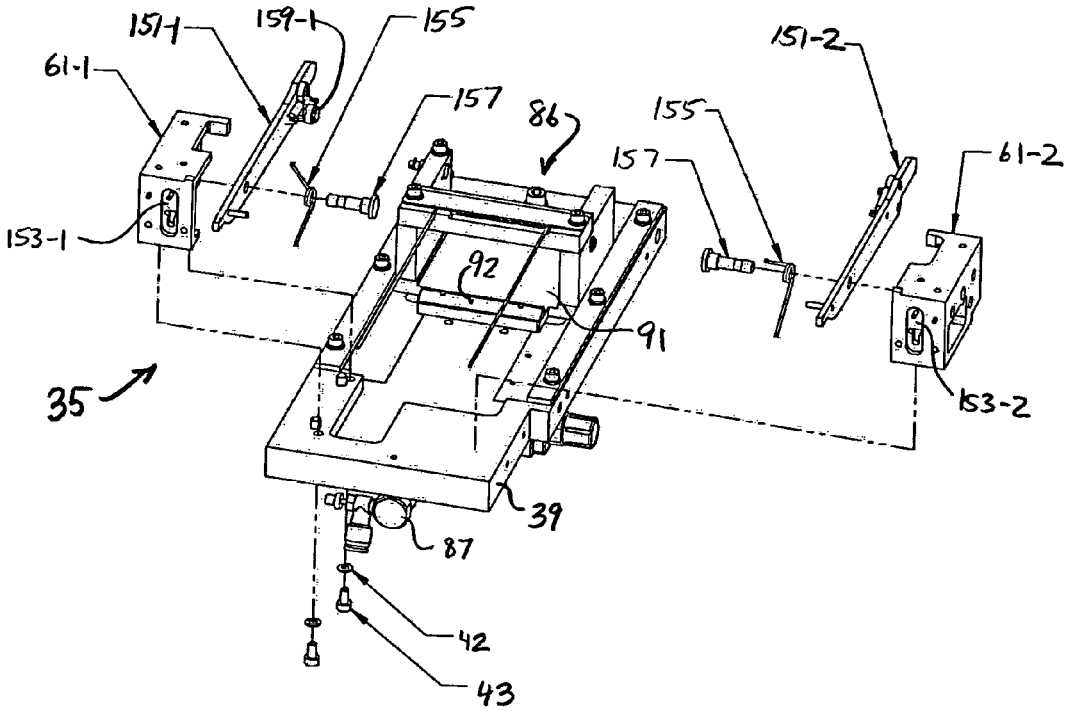
PRIOR ART FIG. 7
FIG. 7 is a partially exploded, front, bottom perspective view of selected internal components of the fastener dispensing device shown in FIG. 1, the device being shown with selected components of its severing mechanism displayed in exploded form.

As seen most clearly in FIGS. 4 and 7, device 10 further comprises first and second spaced apart support brackets 61-1 and 61-2 which are affixed to the top surface of base plate 39 in a spaced apart relationship. It should be noted that support bracket 61-1 is fixedly mounted onto top surface of base plate 39 by pins, whereas support bracket 61-2 is slidably mounted onto top surface of base plate 39 so as to allow for its lateral displacement. As will be described in further below, the ability to slide support bracket 61-2 laterally towards and away from support bracket 61-1 allows for the relative spacing of needles 31 to be adjusted to accommodate ladder stock 11 having a broad range of cross link 17 lengths, which is highly desirable.

Guide bars 63-1 and 63-2 are mounted on support brackets 61-1 and 61-2, respectively, at multiple locations using a washer 41, a lock washer 42 and a screw 43. In addition, guide plates 65-1 and 65-2 are mounted on guide bars 63-1 and 63-2, respectively, using a washer 41, a lock washer 42 and a screw 43. Together, guide bars 63 and guide plates 65 define a pair of narrow guide channels 67 which are sized and shaped to fittingly receive side members 13 and 15 of ladder stock 11. As can be appreciated, the free end of ladder stock 11 which exits out from lower feed guide slot 48 is fed such that side members 13 and 15 axially slide within guide channels 67 and into placement behind needles 31, as will be described further below.

First and second needle holders 69-1 and 69-2 are secured onto the bottom surface of support brackets 61-1 and 61-2, respectively, at multiple locations using a lock washer 42 and a screw 43.

Figure 8:
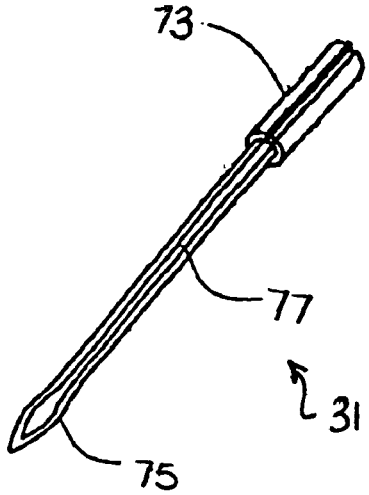
PRIOR ART FIG. 8
FIG. 8 is an enlarged, front perspective view of one of the needles in the fastener dispensing device shown in FIG. 1.

First and second hollowed needles 31-1 and 31-2 are removably mounted onto first and second needle holders 69-1 and 69-2, respectively. As seen most clearly in FIG. 8, each needle 31 is conventional in construction and includes a first end 73, a sharpened second end 75 and an elongated longitudinal bore 77.

As seen most clearly in FIG. 4, first end 73 of each needle 31 is sized and shaped to be fittingly retained within a needle receptacle formed in its associated needle holder 69, needle 31 being releasably retained within the needle receptacle by a manually-operable needle lock 79. Second end 75 of each needle 31 is in the form of a spoon-shaped sharpened tip through which an end bar of fastener 18 may pass during the dispensing process.

Figure 6:
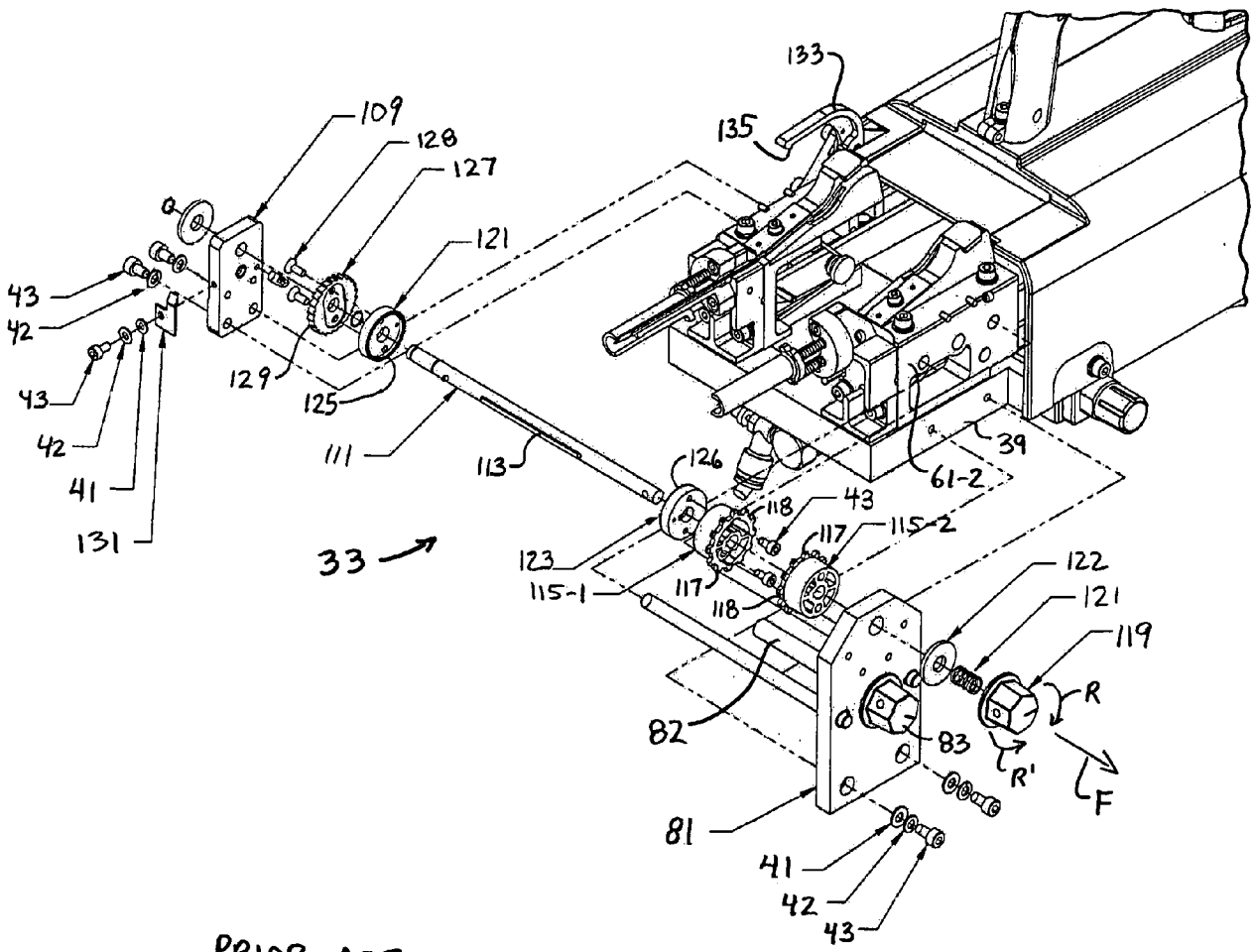
PRIOR ART FIG. 6
FIG. 6 is a fragmentary, perspective, front, right side view of the prior art fastener dispensing device shown in FIG. 1, the device being shown with selected components of its feed mechanism displayed in exploded form.

As seen most clearly in FIG. 6, a support plate 81 is fixedly mounted onto the right edge surface of base plate 39 at multiple locations using a washer 41, a lock washer 42 and a screw 43. Furthermore, a laterally-extending axle 82 is rotatably mounted on support plate 81 with one of its free ends fixedly secured to support bracket 61-2. As such, rotation of axle 82 by means of a spring-biased knob 83 affixed onto the other of its free ends serves to laterally displace movable support bracket 61-2 towards or away from fixed support bracket 61-1. In this capacity, the user is able to vary the spacing between needles 31 through the rotation of knob 83, which is highly desirable.

As seen most clearly in FIG. 4, first and second spring-biased retractable needle guard assemblies 85-1 and 85-2 are fixedly secured onto needle holders 69-1 and 69-2, respectively, over first and second hollowed needles 31-1 and 31-2, respectively. In use, retractable needle guard assemblies 85 serve three principal functions. First, retractable needle guard assemblies 85 provide increased safety for the operator by preventing inadvertent contact of the sharpened point of hollowed needles 31 when device 10 is not in use, which is highly desirable. Second, retractable needle guard assemblies 85 serve as a stiffening, or support, device for needles 31, thereby preventing needle bending and/or breakage, which highly desirable. Third, retractable needle guard assemblies 85 serve as a needle stop for limiting the depth which needles 31 can be inserted through the items to be coupled together using fastener 18, which is highly desirable.

Ejection Mechanism 37 for Prior Art Device 10

Figure 5:
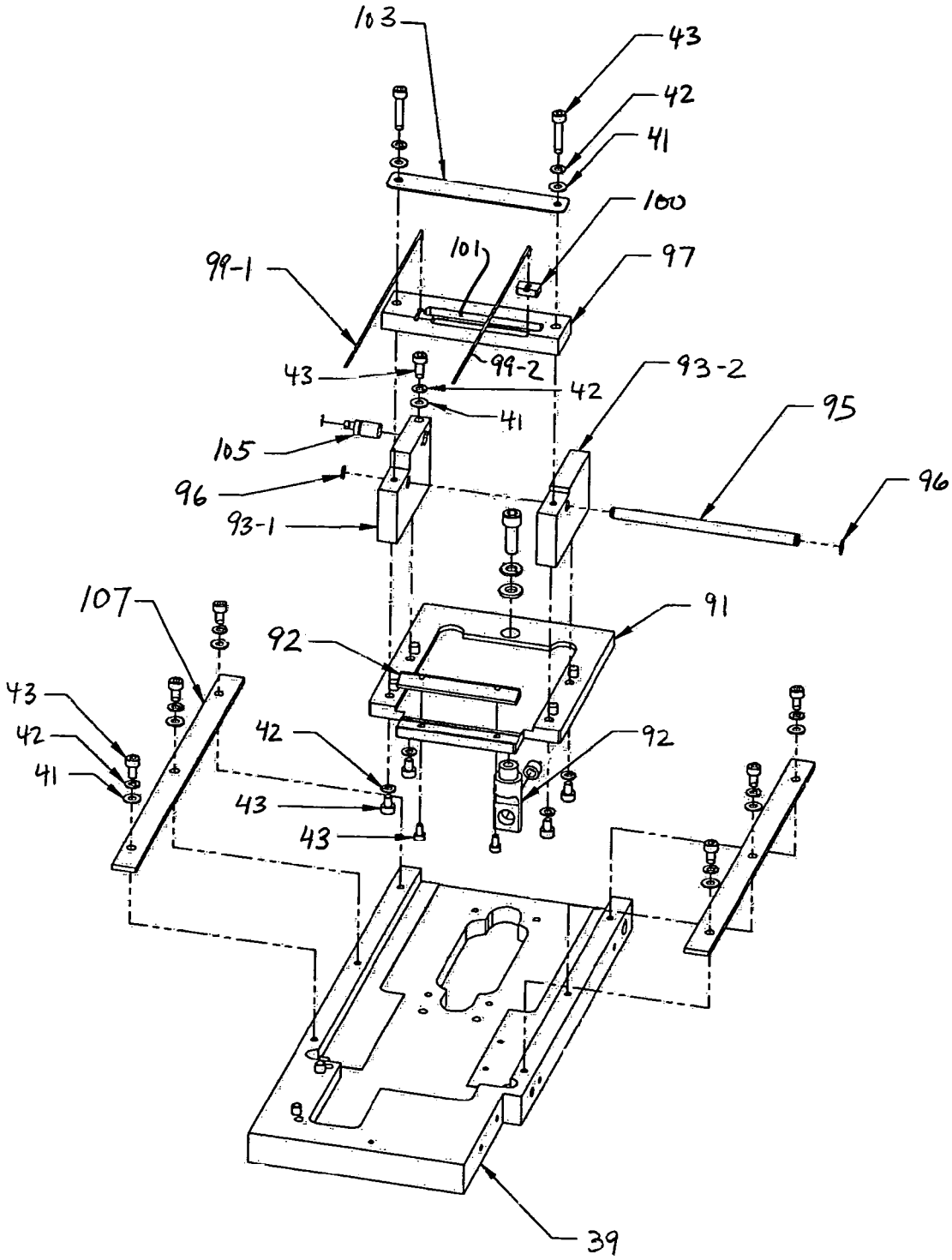
PRIOR ART FIG. 5
FIG. 5 is a partially exploded front, bottom perspective view of selected internal components of the fastener dispensing device shown in FIG. 1, the device being shown with selected components of its ejection mechanism displayed in exploded form.

As seen most clearly in FIGS. 4 and 5, device 10 also comprises an ejection mechanism 37 for dispensing the cross-bars 19 and 21 of a fastener 18 out through needles 31 and, in turn, through the desired items to be coupled together. Ejection mechanism 37 includes an ejector rod slide 86 which is adapted to slide vertically within a shallow recess formed into the front surface of base plate 39, ejector rod slide 86 being powered for vertical displacement by a pneumatic cylinder 87 which operates on 80 pounds per square inch (psi). Application of air pressure from the pneumatic cylinder 87 is effected through the depression of an actuation button 89 which is mounted on handle 46.

Ejector rod slide 86 includes a slide plate 91 which lies flat within the shallow recess formed into front surface of base plate 39. It should be noted that slide plate 91 is coupled to pneumatic cylinder 87 by means of a cylinder bar 92 (and assorted fasteners). In this manner, activation of pneumatic cylinder 87 through the depression of button 89 serves, in turn, to vertically displace slide plate 91 within the shallow recess formed in base plate 39. A laterally extending ramp 92 is affixed to the front surface of slide plate 91 by screws 43, the function of ramp 92 to be described below in conjunction with the operation of severing mechanism 35.

A pair of spaced apart sidewalls 93-1 and 93-2 are affixed to slide plate 91 at multiple locations using a lock washer 42 and a screw 43, sidewalls 93 being disposed so as to protrude orthogonally out from the front of slide plate 91. Sidewalls 93 are secured directly to one another by a laterally disposed return pin 95, each end of pin 95 being fixedly coupled to a corresponding sidewall 93 by a C-ring 96. Furthermore, an ejector pin rail 97 is disposed laterally across front surface of sidewalls 93 and is affixed thereto at multiple locations using a washer 41, a lock washer 42 and a screw 43.

Ejection mechanism 37 additionally includes first and second ejector rods 99-1 and 99-2. First ejector rod 99-1 is fixedly attached to ejector pin rail 97. Second ejector rod 99-2 is fixedly attached to an slide member 100 which, in turn, is slidably mounted within in a slot 101 formed into ejector pin rail 97. Ejector rods 99-1 and 99-2 are retained onto ejector pin rail 97 and slide member 101, respectively, by a plate 103 which is mounted onto ejector pin rail 97 at multiple locations using a washer 41, a lock washer 42 and a screw 43. Ejector rods 99-1 and 99-2 are aligned to extend down through needle holders 69-1 and 69-2, respectively, upon activation of pneumatic cylinder 87. Specifically, as ejector rod slide 86 travels downward, first and second ejector rods 99-1 and 99-2 are aligned to project through the longitudinal bore 77 of first and second needles 31-1 and 31-2, respectively, in order to dispense fastener 18 out from device 10. Furthermore, as ejector rod slide 86 travels upward, first and second ejector rods 99-1 and 99-2 retract from needles 31-1 and 31-2, respectively.

As will be described further in detail below in conjunction with feed mechanism 33, an elliptical cam 105 is disposed in sidewall 93-1. Elliptical cam 105 protrudes at a right angle away form sidewall 93-1 and is accessible by the manufacturer to allow for fine tune adjustments to feed mechanism 33.

A pair of flat, elongated rails 107 are affixed to the top surface of base plate 39 along its side edges, rails 107 being secured to base plate 39 at multiple locations using the combination of a washer 41, a lock washer 42 and a screw 43.

Feed Mechanism 33 for Prior Art Device 10

As noted above, prior art device 10 further comprises a feed mechanism 33 for continuously advancing the free end of ladder stock 11 into alignment behind needles 31 for subsequent ejection therethrough. It should be noted that a particular feature of feed mechanism 33 in prior art device 10 introduces a notable drawback which will be described further in detail below.

Referring now to FIG. 6, a support plate 109 is affixed to the outer surface of fixed support bracket 61-1 at multiple locations using the combination of a lock washer 42 and a screw 43. A generally cylindrical feed shaft 111 extends laterally between support plates 81 and 109. Feed shaft 111 is coupled to support plates 81 and 109 in such a manner so that feed shaft 111 is capable of both rotation about its longitudinal axis and limited displacement in the direction parallel to its longitudinal axis. An outwardly protruding longitudinal rib 113 is formed onto feed shaft 111 along a portion of its length to facilitate in fixedly securing selected components to feed shaft 111.

A pair of spaced apart feed wheels 115-1 and 115-2 are fixedly mounted onto feed shaft 111. In operation, feed wheels 115 are adapted to engage cross links 17 of ladder stock 11 to advance the supply of fastener stock 11 into device 10. Each feed wheel 115 includes twelve sprockets, or teeth, 117, each pair of successive sprockets 117 defining a filament receiving groove 118 therebetween. Teeth 117 are equidistantly arranged about the outer periphery of each feed wheel 115 in a circular configuration.

It should be noted that the present invention is not limited to the particular number of sprockets 117 on each feed wheel 115. Rather, it is to be understood that the number of sprockets 117 on each feed wheel 115 could be modified without departing from the spirit of the present invention.

The spacing (i.e., the circumferential distance) between successive sprockets 117 in each feed wheel 115 is preferably equal to the pitch for ladder stock 11. Stated another way, the distance between successive sprockets 117 in each feed wheel 115 is approximately equal to the distance between successive cross links 17 in ladder stock 11. In this manner, as feed wheel 115 engages ladder stock 11, successive cross links 17 preferably align within successive grooves 118 in feed wheels 115. As a result, the rotation of feed wheels 115 serves to drive (i.e., feed) the supply of ladder stock 11 through prior art device 10.

A feed knob 119 is coupled to one end of feed shaft 111 by a spring 121 and a washer 122. As will be described further below, feed knob 119 allows for three principal manual feed operations: (1) the rotation of feed knob 119 in the clockwise direction (as represented by arrow R in FIG. 6) in order to advance ladder stock 11 into its stop (i.e., loading) position within device 10 prior to ejection; (2) the outward withdrawal of feed knob 119 (as represented by arrow F in FIG. 6) coupled, at the same time, with the rotation of feed knob 119 in the counterclockwise direction (as represented by arrow R' in FIG. 6) in order to back out, or withdraw, supply of ladder stock 11 from device 10; and (3) the outward withdrawal of feed knob 119 (as represented by arrow F in FIG. 6) coupled, at the same time, with the small, incremental rotation of feed knob 119 in either the clockwise or counterclockwise direction in order to fine tune feed mechanism 33 (i.e., to fine tune the stop position in which feed mechanism 33 loads the next successive fastener 18 in ladder stock 11 prior to the severing and ejection processes).

A pair of complementary clutch wheels 121 and 123 are mounted onto feed shaft 111. Clutch wheel 123 is mounted onto feed shaft 111 and is fixedly secured to feed wheel 115-1 at multiple locations using screws 43. In this manner, it is to be understood that clutch wheel 123 is fixedly mounted on feed shaft 111 (i.e., clutch wheel 123 is incapable of rotation or displacement relative to feed shaft 111). To the contrary, clutch wheel 121 is slidably mounted on feed shaft 111 at a location other than over longitudinal rib 113. As a result, clutch wheel 121 is capable of rotation relative to feed shaft 111 about its longitudinal axis.

Clutch wheel 121 includes sixty ratchets 125 which arranged in a circular, equidistantly spaced configuration on one of its surfaces. Similarly, clutch wheel 123 includes sixty ratchets 126 which are arranged in a circular, equidistantly spaced configuration on one of its surfaces. As can be appreciated, ratchets 125 on clutch wheel 121 are sized and shaped to matingly engage ratchets 126 on clutch wheel 123.

As such, with ratchets 125 on clutch wheel 121 engaged with ratchets 126 on clutch wheel 123, rotation of clutch wheel 123 about the longitudinal axis of feed shaft 111, in turn, rotates clutch wheel 121 about the longitudinal axis of feed shaft 111.

It should be noted that there are five times as many ratchets 125 on clutch wheel 121 (or similarly ratchets 126 on clutch wheel 123) as sprockets 117 on feed wheels 115. Stated another way, five ratchets 125 on clutch wheel 121 directly correspond (i.e., in angular deviation about feed shaft 111) to a single sprocket 117 on feed wheels 115. Stated yet another way, the degree of angular deviation between successive ratchets 125 on clutch wheel 121 (or similarly ratchets 126 on clutch wheel 123) about feed shaft 111 (i.e., an angle of 6 degrees) corresponds to one-fifth the degree of angular deviation between successive sprockets 117 on feed wheels 115 about feed shaft 111 (i.e., an angle of 30 degrees). As will be described further below, the fact that the total number of ratchets 125 and 126 on clutch wheels 121 and 123, respectively, is greater than the total number of sprockets 117 on feed wheels 115 enables clutch wheels 121 and 123 to be used as a means for an operator to externally fine-tune adjust feed mechanism 33.

A feed ratchet 127 is mounted on feed shaft 111 between support plate 109 and clutch wheel 121, feed ratchet 127 being capable of rotational movement relative to feed shaft 111 about its longitudinal axis. Feed ratchet 127 is fixedly secured to clutch wheel 121 at multiple locations using a pair of screws 128. Feed ratchet 127 includes twenty-four ratchet-shaped teeth 129 which are equidistantly spaced about its outer periphery in a circular configuration.

As can be appreciated, feed ratchet 127 includes twice as many teeth 129 as feed wheels 115 have sprockets 117. Accordingly, it should be noted that two teeth 129 on feed ratchet 127 directly correspond (i.e., in angular deviation about feed shaft 111) to a single sprocket 117 on feed wheel 115.

As will be described further in detail below, feed ratchet 127 is coupled indirectly to feed wheels 115. Accordingly, the rotation of feed ratchet 127 in the clockwise direction serves to similarly rotate feed wheels 115 in the clockwise direction which, in turn, advances ladder stock 11 in the forward direction into prior art device 10. Consequently, rotation of feed ratchet 127 in the counterclockwise direction would serve to rotate feed wheels 115 in the opposite direction (i.e., such that ladder stock 11 is withdrawn, or backed out, from prior art device 10. However, it has been found that, during the automated feeding process for prior art device 10, any slight rearward withdrawal of ladder stock 11 can cause ladder stock 11 to become jammed within prior art device 10, which is highly undesirable.

Accordingly, an anti-back ratchet 131 is affixed to support plate 109 using the combination of a washer 41, a lock-washer 42 and a screw 43. Anti-back ratchet 131 is shaped and positioned to limit feed ratchet 127 to rotation in the clockwise direction only (as represented by arrow R in FIG. 6). In this manner, anti-back ratchet 131 precludes feed ratchet 127 from rotating in the counterclockwise direction, thereby preventing ladder stock 11 from jamming within device 10.

As seen most clearly in FIG. 4, a pivotable feed pawl 133 includes a finger 135 at one of its ends, finger 135 being adapted to selectively engage a tooth 129 on feed ratchet 127. The opposite end of feed pawl 133 is pivotally connected to one end of a movable feed link 137 and to one end of a feed lever 139 using the combination of a spacer 141, a washer 41, a lock-washer 42 and a screw 43. In addition, feed lever 139 is pivotally connected to support bracket 61-1 using the combination of a spacer 141, a washer 41, a lock-washer 42 and a screw 43. Furthermore, elliptical cam 105 on sidewall 93-1 of ejector rod slide 86 projects through a slot 145 formed in feed link 137. As will be described further below, together ejector rod slide 86, feed link 137 and feed lever 139 selectively pivot feed pawl 133 in such a manner so that finger 135 engages a tooth 129 on feed ratchet 127 and rotates feed ratchet 127 in the clockwise direction. A spring 147 connects feed pawl 133 to support bracket 61-1 in order to bias finger 135 downward and into contact with feed ratchet 127.

Operation of Feed Mechanism 33 in Prior Art Device 10

Feed mechanism 33 operates in the following manner to feed ladder stock 11 into position within device 10 for the subsequent severing of a fastener 18 from the remainder of ladder stock 11 and, in turn, for the ejection of said severed fastener 18 out through needles 31.

Initially, the user must manually feed the free end of the supply of ladder stock 11 into position for subsequent automatic operation. Specifically, the user is required to manually advance the free end of ladder stock 11 such that side members 13 and 15 position within the guide channels 67 and in alignment immediately behind needles 31. As the side members 13 and 15 are disposed, by hand, into guide channels 67, eventually the lowermost cross link 17 in the ladder stock 11 aligns within a corresponding groove 118 in each feed wheel 115. At this time, the user can manually rotate feed knob 119 in the clockwise direction R which, in turn, similarly rotates feed wheels 115 in the clockwise direction. As feed wheels 115 rotate in the clockwise direction, feed wheels 115 engage cross links 17 and advance fastener stock 11 through guide channels 67 and ultimately to its stop position. With fastener stock 11 disposed in its stop position, side members 13 and 15 are disposed in direct axial alignment behind the longitudinal bores 77 of needles 31. This completes the initial manual feed of ladder stock 11 into device 10.

After the initial manual feed of ladder stock 11 has been completed, the process for continuously feeding ladder stock 11 into position within device 10 is performed automatically using air pressure. Specifically, the activation of pneumatic cylinder 87 through the depression of button 89 on handle 46 commences the forward stroke of ejector rod slide 86. As the ejector rod slide 86 slides downward along base plate 39 in the direction towards needles 31, elliptical cam 105 similarly travels downward within slot 145 in feed link 137. Ultimately elliptical cam 105 contacts feed link 137 at the front end of slot 145 and urges feed link 137 forward such that, in combination with feed lever 139, feed pawl 133 similarly pivots forward. It should be noted that ejector rod slide 86 advances forward until feed pawl 133 ratchets past a pair of teeth 129 on feed ratchet 127.

With feed pawl 133 advanced past a pair of teeth 129 on feed ratchet 127, severing mechanism 35 cuts the lowermost fastener 18 from the remainder of fastener stock 11 (said severing process to be described further below). With the lowermost fastener 18 severed, the continued forward (i.e., downward) stroke of ejector rod slide 86 causes ejector rods 99 to urge cross-bars 19 and 21 of the severed fastener 18 out through needles 31.

Upon completion of the ejection process, pneumatic cylinder 87 commences the rearward (i.e., upward) stroke for ejector rod slide 86. As ejector rod slide 86 slides up along base plate 39 in the direction away from needles 31, elliptical cam similarly travels upward within slot 145 in feed link 137. Ultimately, elliptical cam 105 contacts feed link 137 at the rear end of slot 145 and urges feed link 137 rearward such that, in combination with feed lever 139, feed pawl 133 pivots rearward (with spring 147 urging finger 135 in constant contact with feed ratchet 127). As feed pawl 133 pivots rearward, finger 135 engages a tooth 129 and similarly rotates feed ratchet 127 in the clockwise direction.

Rotation of feed ratchet 127 in the clockwise direction, in turn, causes clutch wheel 121 (which is connected to feed ratchet 127) to rotate in the clockwise direction which, in turn, causes clutch wheel 123 (which is in resilient engagement with clutch wheel 123) to rotate in the clockwise direction which, in turn, causes feed wheel 115-1 (which is connected to clutch wheel 123) to rotate in the clockwise direction. Rotation of feed wheel 115-1 rotates feed shaft 111 which, in turn, rotates feed wheel 115-2. Rotation of feed wheels 115 in the clockwise direction advances ladder stock 11 within prior art device 10.

Feed mechanism 33 is designed such that the rearward stroke of ejector rod slide 86, in turn, advances ladder stock 11 forward the distance of a single fastener 18. Stated another way, feed mechanism 33 is designed to advance ladder stock 11 at a rate equal to the pitch of feed wheels 115. Accordingly, after the ejection of the lowermost fastener 18 in ladder stock 11, feed mechanism 33 advances the next subsequent fastener 18 in ladder stock 11 to the proper stop position directly behind needles 31. The aforementioned automated feed process can be repeated, as necessary, to provide for the continuous incremental feeding of ladder stock 11 into prior art device 10.

It should be noted feed mechanism 33 is provided with a manual means for backing out ladder stock 11 from device 10 (which is useful in the case of a jamming condition). In order to back out ladder stock 11 from device 10, the user is required to withdraw feed knob 119 away from support plate 81 (as represented by arrow F in FIG. 6). The withdrawal of feed knob 119 similarly displaces feed shaft 111 in the direction represented by arrow F in FIG. 6. Because clutch wheel 123 is fixedly mounted on feed shaft 111 and clutch wheel 121 is rotatably mounted on feed shaft 111, the displacement of feed shaft 111 away from support plate 109 causes clutch wheels 121 and 123 to temporarily disengage (i.e., separate). With clutch wheels 121 and 123 disengaged, feed knob 119 is rotated in the counterclockwise direction (as represented by arrow R' in FIG. 8) which, in turn, rotates feed wheels 115 in the counterclockwise direction. As feed wheels 115 rotate in the counterclockwise direction, feed wheels 115 engage cross links 17 and back out the fastener stock 11 from device 10, which is highly desirable. Because clutch wheels 121 and 123 are disengaged from one another during the backing out process, it should be noted that feed ratchet 127 remains stationary during the process. As can be appreciated, it is a desirable feature that feed ratchet 127 remain stationary as feed shaft 111 rotates in the counterclockwise because anti-back ratchet 131 precludes feed ratchet 127 from counterclockwise rotation, as noted above.

Conventional applications for fastener 18 require that severing mechanism 35 cut side members 13 and 15 at the approximate mid-point between successive cross links 17. In this manner, device 10 dispenses fasteners 18 from ladder stock 11 which have an H-shape configuration, with each end of filament 23 bisecting cross-bars 19 and 21.

However, it has been found that, on occasion, feed mechanism 33 does not accurately advance the lowermost fastener 18 in ladder stock 11 to the proper stop position prior to the severing process. Rather, manufacturing tolerances in ladder stock 11 as well as in device 10 can cause feed mechanism 33 to advance the lowermost fastener 18 in ladder stock 11 to a position other than its proper stop position. As a result, the severing process separates a fastener 18 from the remainder of ladder stock 11 which fails to have an H-type configuration, which is highly undesirable.

Accordingly, feed mechanism 33 is provided with two principal means for adjusting the relative stop position of the lowermost fastener 18 in ladder stock 11 prior to the severing process. Specifically, feed mechanism 33 includes an internal (i.e., factory set) fine tune (i.e., micro) adjustment to feed mechanism 33 as well as an external (i.e., operator accessible) fine tune adjustment to feed mechanism 33.

The internal fine tune adjustment to feed mechanism 33 is carried out using elliptical cam 105. Specifically, due to its inherent construction, elliptical cam 105 can be displaced incrementally up or down relative to sidewall 93-1 (as represented by arrows D and D' in FIG. 4) simply through its rotation (e.g., using a screwdriver). As can be appreciated, the incremental displacement of elliptical cam 105 relative to sidewall 93-1 effects the degree of the rotational pull that feed pawl 133 exerts on feed ratchet 127 during the feed process. Accordingly, the degree of rotational pull that feed pawl 133 exerts on feed ratchet 127 can be adjusted such that the lowermost fastener 18 in ladder stock 11 is advanced by feed mechanism 33 to its proper stop position. It should be noted that the adjustment to elliptical cam 105 requires a considerable degree of precision and it is designed to be performed by the manufacturer (during the construction of device 10).

The external fine tune adjustment to feed mechanism 33 is carried out using feed knob 119. Specifically, after feed knob 119 is pulled outward (in the direction of arrow F in FIG. 6) such that clutch wheels 121 and 123 become disengaged, feed knob 119 is incrementally rotated in either the clockwise or counterclockwise direction. Once rotated a satisfactory degree, withdrawal force F is removed which, in turn, causes feed spring 121 to return clutch wheels 121 and 123 to their engaged state. As can be appreciated, because clutch wheels 121 and 123 have five times as many ratchets 125 and 126, respectively, as feed wheels 115 have sprockets 117, feed knob 119 can be rotated in increments which are one-fifth the distance between successive sprockets 117 in feed wheels 115, thereby providing the necessary fine tune adjustments that are necessary to ensure that the feed mechanism 33 advances the lowermost fastener 18 in ladder stock 11 to the proper stop position.

Severing Mechanism 35 for Prior Art Device 10

As noted above, system 10 additionally comprises a severing mechanism 35 for severing the lowermost fastener 18 from fastener stock 11 after fastener stock 11 has been advanced to its stop position by feed mechanism 33. Once severing mechanism 35 completes the separation of the lowermost fastener 18 from ladder stock 11, the severed fastener 18 is then expelled through needles 31 by ejection mechanism 37.

As seen most clearly in FIGS. 4 and 7, severing mechanism 35 comprises a pair of sharpened knife blades 149-1 and 149-2, each blade 149 being pivotably disposed between an associated support bracket 61 and an associated needle holder 69. It should be noted that knife blades 149 are disposed so as to align directly between the two lowermost cross links 17 in ladder stock 11 when ladder stock 11 is advanced to its stop position. In this manner, displacement of knife blades 149 serves to sever side members 13 and 15 at a location which ensures that the fastener 18 severed from ladder stock 11 has the desired H-shaped configuration.

Severing mechanism 35 also comprises a pair of knife levers 151-1 and 151-2 which are connected to knife blades 149-1 and 149-2, respectively, by means of knife arms 153-1 and 153-2, respectively. Each knife lever 151 is pivotally coupled to an associated support bracket 61 by a spring 155 and a shaft 157. As can be appreciated, shaft 157 enables the front end of each knife lever 151 to pivot relative to its associated support bracket 61, with spring 155 resiliently urging the front end of said knife lever 151 back to its original position. A pair of knife rollers 159-1 and 159-2 are rotatably mounted on knife levers 151-1 and 151-2, respectively, proximate its rear end.

During the operation of severing mechanism 35, knife rollers 159 are continuously biased downward in the direction towards base plate 39 by its corresponding spring 155. Accordingly, as ejector rod slide 86 begins its downward stroke, knife rollers 159 eventually travel up and over ramp 92 on slide plate 91. The upward displacement of knife rollers 159 as they pass over ramp 92, in turn, pivots the front end of knife levers 151 such that knife blades 149 sever side members 13 and 15 at the approximate midpoint between the two lowermost cross links 17 in ladder stock 11. It should be noted that spring-biased knife levers 151 are designed only to activate knife blades 149 as ejector rod slide 86 begins its downward stroke and not when ejector rod slide 86 completes its upward stroke, which is highly desirable.

One Conventional use for Prior Art Device 10

In use, prior art device 10 can be used to affix a product for sale onto a display card using one or more plastic fasteners 18 from fastener stock 11 in the following manner. The display card is placed on top of an anvil and the product for sale, in turn, is placed on top of the display card C. The user then grasps handle 46 of device 10 and urges it downward so that needles 31 pierce through the display card, needles 31 being disposed on opposite sides of the product for sale. Needles 31 are disposed through the display card and down between the filaments of the anvil. With needles 31 disposed through the display card, actuation button 89 is depressed to eject a single fastener 18 out through needles 31. The ejection of single fastener 18 disposes cross bars 19 and 21 on the opposite side of the display card than the product, filament 23 of fastener 18 being drawn tightly against the product so as to securely couple it to the display card.

Principal Drawback Associated with Prior Art Device 10

The principal drawback associated with prior art device 10 relates to its feed mechanism 33. As noted above, feed mechanism 33 is provided with two principal means for fine tune adjusting the relative stop position of the lowermost fastener 18 in ladder stock 11 prior to the severing and ejection processes. Specifically, feed mechanism 33 can be micro-adjusted either by (1) adjusting the position of elliptical cam 105 relative to sidewall 93-1; or (2) adjusting the position of clutch wheel 123 relative to clutch wheel 121.

The adjustment of elliptical cam 105 is designed to be performed by the manufacturer prior to shipping prior art device 10 to a customer. As a result, the position of elliptical cam 105 is a factory-set operation and is not intended to be adjusted by the customer. It is for this reason that elliptical cam 105 is not externally accessible, thereby discouraging manipulation by the customer.

To the contrary, the adjustment of the position of clutch wheel 123 relative to clutch wheel 121 is designed to be performed by the customer. It is for this reason that the adjustment of the position of clutch wheel 123 relative to clutch wheel 121 is accomplished via externally-accessible feed knob 119, thereby encouraging manipulation by the consumer.

It should be noted that fine-tune adjusting feed mechanism 33 to ensure that side members 13 and 15 are severed at the precise midpoints between successive cross links 17 (and thereby dispense individual fasteners 18 having the optimal H-type configuration) requires a considerable level of precision which is typically found with only the more experienced and methodical users. It is for this reason that adjustment of elliptical cam 105 is preferably factory-set. In this manner, feed mechanism 33 can be adjusted by the manufacturer, as required, and then shipped to the customer in such a condition which does not require any further fine tune adjustment to feed mechanism 33.

However, it has been found that customers nonetheless attempt to adjust feed mechanism 33 without recognizing that feed mechanism 33 has already been optimized for use by the manufacturer during its construction. Specifically, the customer is able to further adjust feed mechanism 33 by rotating externally-accessible feed knob 119 such that clutch wheel 123 is rotated in small increments relative to clutch wheel 121. As a result, it has been found that, more often than not, the presence of externally-accessible means for adjusting feed mechanism 33 causes the customer to introduce misalignment into feed mechanism 33 after it has already been optimized for operation by the manufacturer, which is highly undesirable. Accordingly, the present invention serves to eliminate the ability of the customer to fine tune adjust feed mechanism 33 while, at the same time, maintaining the ability of the user to manually insert or withdraw ladder stock 11 from the fastener dispensing machine using an externally-accessible knob, as desired.

Fastener Dispensing Device 210 of the Present invention

Figure 9:
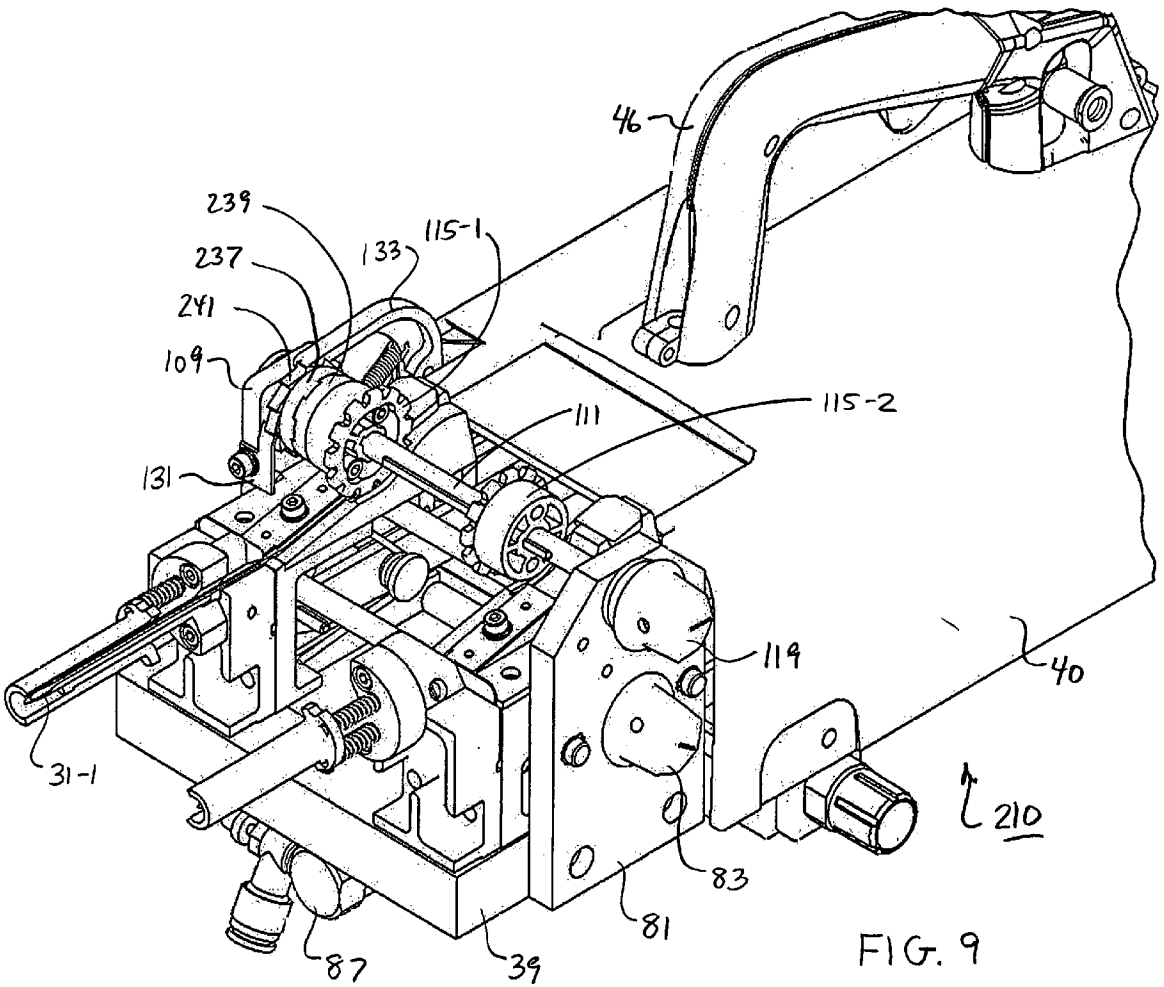
FIG. 9 is a fragmentary, front, right side perspective view of a novel fastener dispensing device which has been constructed according to the teachings of the present invention.
Figure 10:
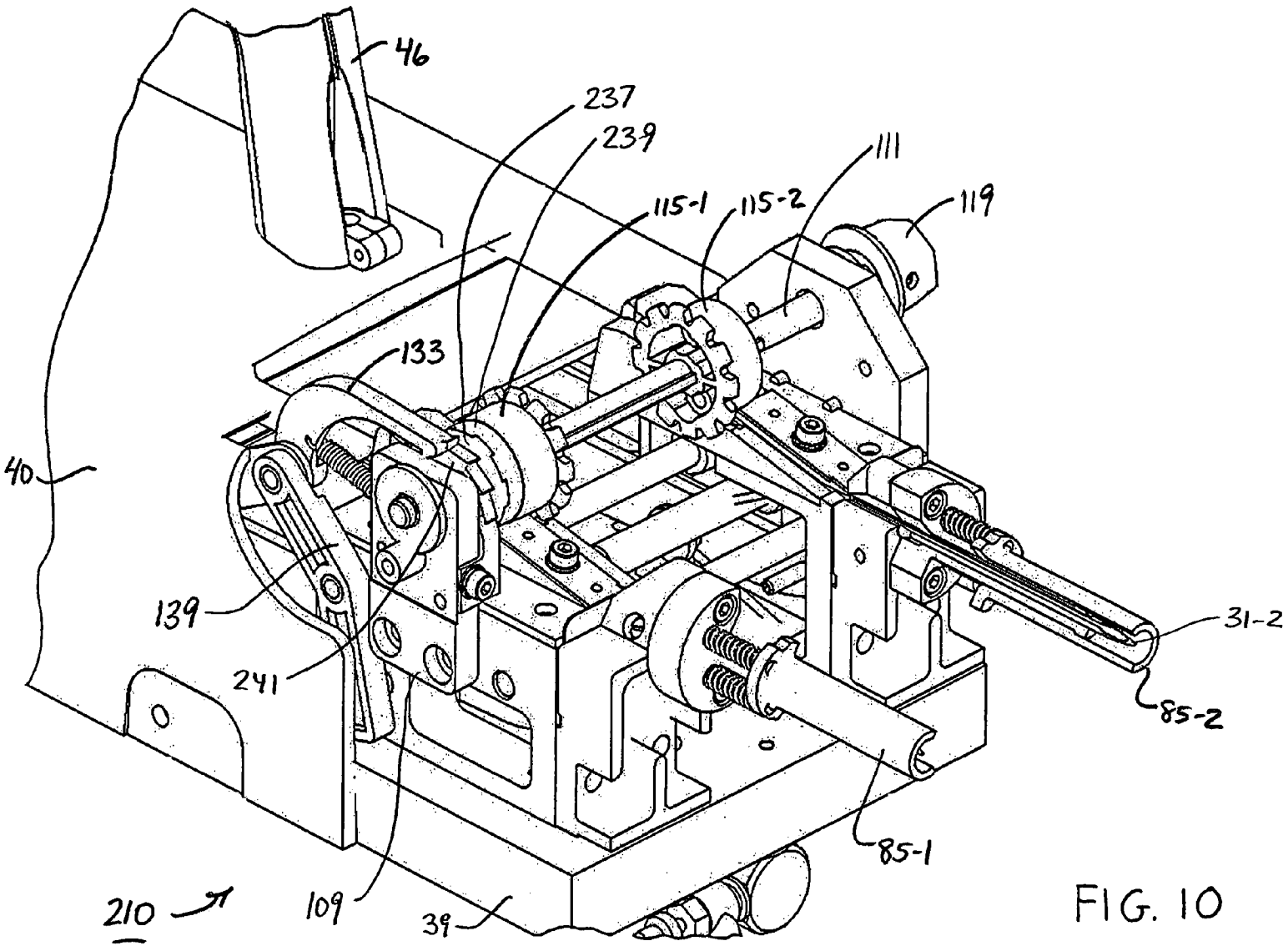
FIG. 10 is a fragmentary, front, left side perspective view of the fastener dispensing device shown in FIG. 9.
Figure 11:
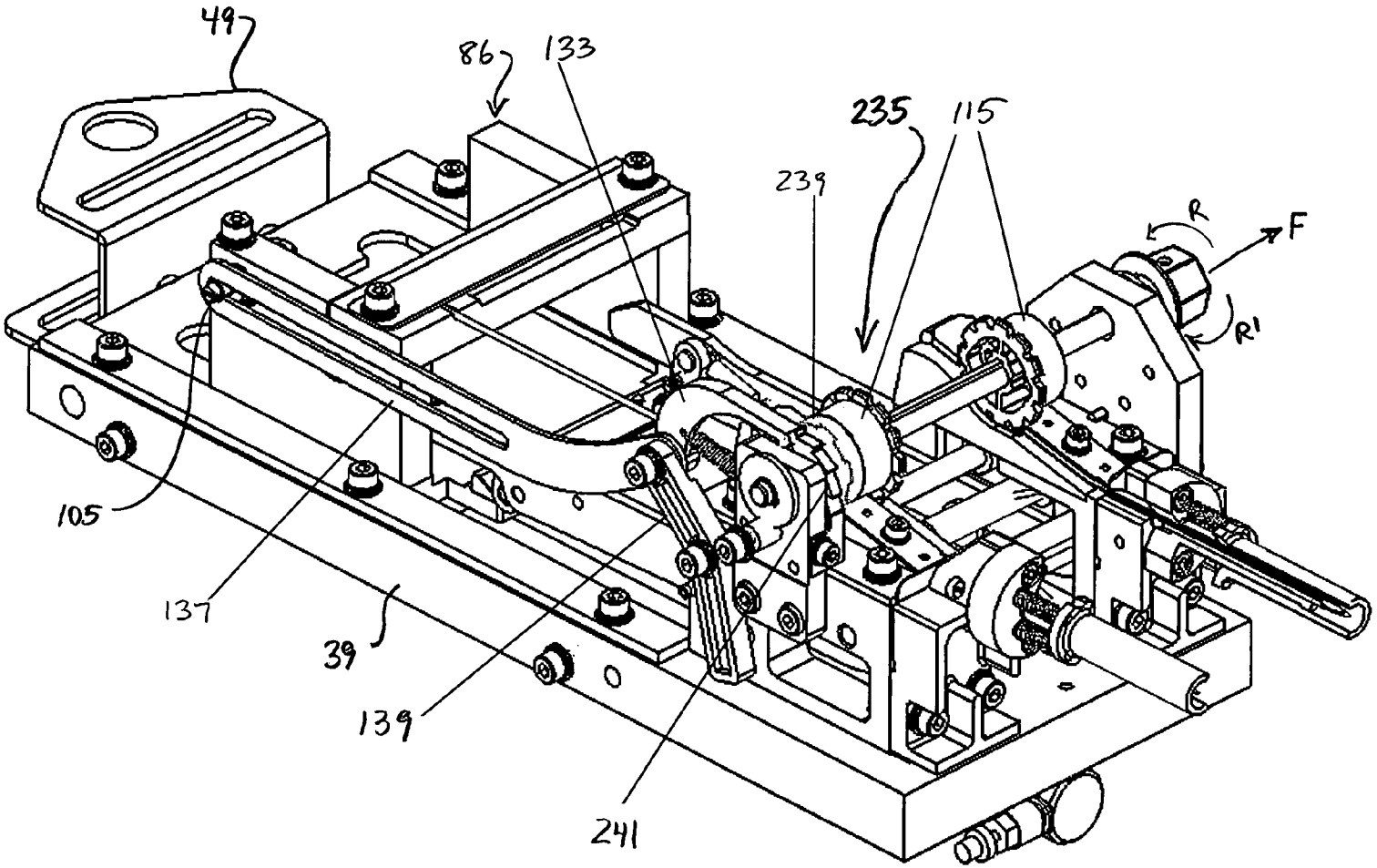
FIG. 11 is a front, left side perspective view of the fastener dispensing device shown in FIG. 9, the device being shown with components of its protective housing removed therefrom in order to display selected interior components.

Accordingly, there is shown in FIGS. 9 and 10, a new and improved device for dispensing individual fasteners 18 from a supply of fastener stock 11 which is constructed according to the teachings of the present invention, the device being identified generally by reference numeral 210.

The principal distinction between device 210 and device 10 is that device 210 includes a feed mechanism 235 which differs in construction from feed mechanism 35 in prior art device 10.

As will be described in detail below, feed mechanism 235 is identical to feed mechanism 35 in all respects with two notable distinctions: (1) feed mechanism 235 includes a pair of clutch wheels 237 and 239 which have a fewer number of ratchets than clutch wheels 121 and 123 in feed mechanism 35, and (2) feed mechanism 235 includes a feed ratchet 241 having a fewer number of teeth than are present on feed ratchet 127 in feed mechanism 35.

Figure 12:
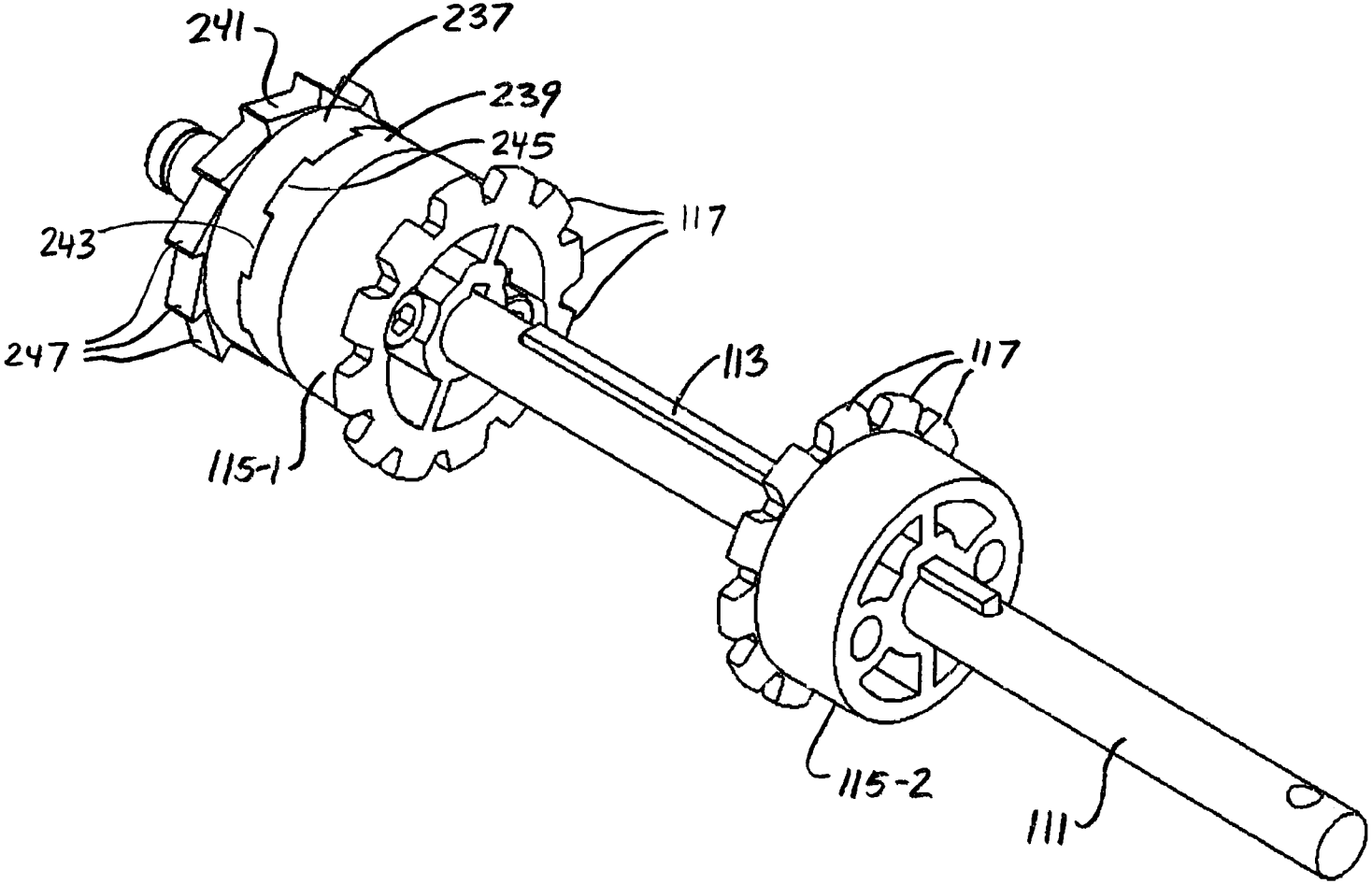
FIG. 12 is an enlarged, front, right side perspective view of the feed shaft, feed wheels, clutch wheels and feed ratchet shown in FIG. 11.

Specifically, as seen most clearly in FIG. 12, clutch wheels 237 and 239 are mounted on feed shaft 111 in device 210 in the same manner in which clutch wheels 121 and 123, respectively, are mounted on feed shaft 111 in device 10. Clutch wheel 237 includes six ratchets 243 which are arranged in a circular, equidistantly spaced configuration on one of its surfaces. Similarly, clutch wheel 239 includes six ratchets 245 which are arranged in a circular, equidistantly spaced configuration on one of its surfaces. Ratchets 243 on clutch wheel 237 are sized and shaped to matingly engage ratchets 245 on clutch wheel 239. As such, with ratchets 243 on clutch wheel 237 engaged with ratchets 245 on clutch wheel 239, rotation of clutch wheel 239 about the longitudinal axis of feed shaft 111, in turn, rotates clutch wheel 237 about the longitudinal axis of feed shaft 111.

In use, clutch wheels 237 and 239 operate in the same manner as clutch wheels 121 and 123, respectively. However, as noted above, clutch wheels 237 and 239 include a fewer number of ratchets than clutch wheels 121 and 123. In particular, feed mechanism 235 is specifically designed such that there are one-half the number of ratchets 243 and 245 on clutch wheels 237 and 239, respectively, as there are sprockets 117 on feed wheels 115. Stated another way, two sprockets 117 on each feed wheel 115 directly correspond (i.e., in angular deviation about feed shaft 111) to a single ratchet 243 on clutch wheel 237 (or similarly to a single ratchet 245 on clutch wheel 239). Stated yet another way, the degree of angular deviation between successive ratchets 243 on clutch wheel 237 (or similarly ratchets 245 on clutch wheel 239) about feed shaft 111 (i.e., an angle of 60 degrees) corresponds to two times the degree of angular deviation between successive sprockets 117 on feed wheels 115 about feed shaft 111 (i.e., an angle of 30 degrees).

Because the number of ratchets 243 on clutch wheel 237 (and similarly the number of ratchets 245 on clutch wheel 239) is less than the number of sprockets 117 on feed wheels 115, clutch wheels 237 and 239 can not be used to micro (i.e., fine tune) adjust feed mechanism 235. Rather, each incremental adjustment of clutch wheel 239 relative to clutch wheel 237 in turn rotates feed wheels 115 two increments which, in turn, advances ladder stock 11 forward or backward (depending on the direction of the rotation of feed knob 119) a distance equal to the spacing between three successive cross links 17 in ladder stock 11.

Accordingly, it should be noted that feed mechanism 235 allows for only a single means for fine tune (i.e., micro) adjusting the relative stop position of the lowermost fastener 18 in ladder stock 11 prior to the fastening process. Specifically, the fine tune adjustment of feed mechanism 235 is only possible using elliptical cam 105. However, because any adjustment of elliptical cam 105 is intended to be performed only by the manufacturer (which is accomplished by disposing cam 105 within internal cavity 44), the consumer is precluded from performing fine tune adjustments on feed mechanism 235, which is the principal object of the present invention.

Although the consumer is adequately prevented from performing fine tune adjustments on feed mechanism 235, it is to be understood that feed mechanism 235 operates similar to feed mechanism 35 in that feed mechanism 235 still allows the customer to manually feed ladder stock 11 into device 210 as well as manually back out ladder stock 11 from device 210 using a single feed knob 119, which is highly desirable.

It should be noted that feed mechanism 235 for device 210 is not limited to including a pair of clutch wheels 237 and 239 which include six ratchets. Rather, it is to be understood that each of clutch wheels 237 and 239 could have a greater or fewer number of ratchets without departing from the spirit of the present invention. Specifically, it is to be understood that each of clutch wheels 237 and 239 could be provided with any number of ratchets which is equal to or less than the number of sprockets 117 on each feed wheel 115. Preferably, the number of ratchets 243 on clutch wheel 237 (and similarly the number of ratchets 245 on clutch wheel 239) is either (1) equal to the number of sprockets 117 on each feed wheel 115 or (2) an even number fraction (e.g., ½, ¼, ⅙, etc.) of the number of sprockets 117 on each feed wheel 115. As an example, since each feed wheel 115 is shown having twelve sprockets 117, clutch wheels 237 and 239 could be modified under the scope of the present invention to include (1) an equal number of ratchets (i.e., twelve ratchets) or (2) an even number fraction of ratchets (e.g., six ratchets or three ratchets) without departing from the spirit of the present invention.

As seen most clearly in FIGS. 10 and 12, feed ratchet 241 is mounted on feed shaft 111 in device 210 in the same manner in which feed ratchet 127 is mounted on feed shaft 111 in device 10. Specifically, feed ratchet 241 is mounted on feed shaft 111 between support plate 109 and clutch wheel 237, feed ratchet 241 being capable of rotational movement relative to feed shaft 111 about its longitudinal axis. In addition, feed ratchet 241 is fixedly secured to clutch wheel 237 at multiple locations.

Feed ratchet 241 includes twelve teeth 247 which are equidistantly spaced about its outer periphery in a circular configuration. In use, feed ratchet 241 operates in the same manner as feed ratchet 127 in device 10. However, as noted above, feed ratchet 241 includes a fewer number of teeth than feed ratchet 127. Specifically, feed ratchet 241 is designed to include one-half the number of teeth which are present on feed ratchet 127. As a result, feed ratchet 241 includes the same number of teeth 247 that each feed wheel 115 includes sprockets 117. Stated another way, the number of teeth 247 on feed ratchet 241 form a direct one-to-one correspondence with the number of sprockets 117 on feed wheels 115.

In operation, feed ratchet 241 operates in a similar manner to feed ratchet 127. However, since the number of teeth 247 on each feed ratchet 241 is equal to the number of sprockets 117 on each feed wheel 115, feed ratchet 241 needs only be incrementally advanced one tooth 247 at a time in conjunction with each stroke of ejector rod slide 86. As a result, finger 135 on feed pawl 133 need only be advanced over a single tooth 247 in feed ratchet 241 during the downward stroke for ejector rod slide 86 (rather than over a pair of teeth as is the case in device 10). As can be appreciated, the fact that feed ratchet 241 includes one-half the number of teeth as feed ratchet 127 renders feed mechanism 235 more efficient, simplified and reliable than feed mechanism 35, which is highly desirable.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A device for dispensing an individual fastener from a supply of fastener stock, the fastener stock being shaped to include a continuous side rail to which are coupled a plurality of equidistantly spaced cross links, the individual fastener including a filament coupled at one end to a cross-bar, the device comprising:

(a) a hollowed needle shaped to define a longitudinal bore, (b) a feed mechanism for advancing the continuous side rail of the fastener stock into direct axial alignment behind the longitudinal bore of the hollowed needle, the feed mechanism comprising, (i) a rotatably mounted feed shaft, (ii) a feed wheel fixedly mounted on the feed shaft, the feed wheel comprising a plurality of sprockets which are sized and shaped to engage the supply of fastener stock, and (iii) first and second clutch wheels which are releasably matingly engageable with one another, the first clutch wheel being fixedly mounted on the feed shaft and the second clutch wheel being rotatably mounted on the feed shaft, each of the first and second clutch wheels including a plurality of ratchets, (iv) wherein the number of ratchets on each of the first and second clutch wheels is at most equal to the number of sprockets on the feed wheel, (c) a severing mechanism adapted to cut the continuous side rail of the supply of ladder stock to yield the individual fastener, and (d) an ejection mechanism for ejecting the cross-bar of the individual fastener axially through the longitudinal bore defined by the hollowed needle.

2. The device of claim 1 wherein the feed mechanism further comprises a feed ratchet rotatably mounted on the feed shaft and fixedly coupled to the second clutch wheel.

3. The device of claim 2 wherein the feed ratchet includes a plurality of teeth.

4. The device of claim 3 wherein the teeth on the feed ratchet are arranged in a substantially circular configuration, adjacent teeth on the feed ratchet being spaced an equal distance apart from one another.

5. The device of claim 4 wherein the number of teeth on the feed ratchet is equal to the number of sprockets on the feed wheel.

6. The device of claim 5 wherein the feed ratchet includes twelve teeth.

7. The device of claim 6 wherein said feed mechanism further comprises a pivotally mounted feed pawl which is coupled to the ejection mechanism, the feed pawl being adapted to selectively engage a tooth on the feed ratchet.

8. The device of claim 1 wherein the sprockets on the feed wheel are arranged in a substantially circular configuration, adjacent sprockets being spaced an equal distance apart from one another.

9. The device of claim 8 wherein the feed wheel includes twelve sprockets.

10. The device of claim 1 wherein the ratchets on the first clutch wheel are adapted to matingly engage the ratchets on the second clutch wheel.

11. The device of claim 10 wherein the first clutch wheel can be rotated relative to the second clutch wheel.

12. The device of claim 10 wherein the ratchets on each of the first and second clutch wheels are arranged in a substantially circular configuration, adjacent ratchets on each of the first and second clutch wheels being spaced an equal distance apart from one another.

13. The device of claim 10 wherein the number of ratchets on each of the first and second clutch wheels is an even number fraction of the number of sprockets on the feed wheel.

14. The device of claim 13 wherein each of the first and second clutch wheels includes six ratchets.

15. A feed mechanism for advancing a supply of fastener stock within a fastener dispensing device, the feed mechanism comprising, (i) a rotatably mounted feed shaft, (ii) a feed wheel fixedly mounted on the feed shaft, the feed wheel comprising a plurality of sprockets which are sized and shaped to engage the supply of fastener stock, and (iii) first and second clutch wheels which are releasably matingly engageable with one another, the first clutch wheel being fixedly mounted on the feed shaft and the second clutch wheel being rotatably mounted on the feed shaft, each of the first and second clutch wheels including a plurality of ratchets, (iv) wherein the number of ratchets on each of the first and second clutch wheels is at most equal to the number of sprockets on the feed wheel.

16. The feed mechanism of claim 15 wherein the feed mechanism further comprises a feed ratchet rotatably mounted on the feed shaft and fixedly coupled to the second clutch wheel.

17. The feed mechanism of claim 16 wherein the feed ratchet includes a plurality of teeth.

18. The feed mechanism of claim 17 wherein the teeth on the feed ratchet are arranged in a substantially circular configuration, adjacent teeth on the feed ratchet being spaced an equal distance apart from one another.

19. The feed mechanism of claim 18 wherein the number of teeth on the feed ratchet is equal to the number of sprockets on the feed wheel.

20. The feed mechanism of claim 19 wherein the feed ratchet includes twelve teeth.

21. The feed mechanism of claim 20 wherein the feed mechanism further comprises a pivotally mounted feed pawl which is adapted to selectively engage a tooth on the feed ratchet.

22. The feed mechanism of claim 15 wherein the sprockets on the feed wheel are arranged in a substantially circular configuration, adjacent sprockets being spaced an equal distance apart from one another.

23. The feed mechanism of claim 22 wherein the feed wheel includes twelve sprockets.

24. The feed mechanism of claim 15 wherein the ratchets on the first clutch wheel are adapted to matingly engage the ratchets on the second clutch wheel.

25. The feed mechanism of claim 24 wherein the first clutch wheel can be rotated relative to the second clutch wheel.

26. The feed mechanism of claim 24 wherein the ratchets on each of the first and second clutch wheels are arranged in a substantially circular configuration, adjacent ratchets on each of the first and second clutch wheels being spaced an equal distance apart from one another.

27. The feed mechanism of claim 24 wherein the number of ratchets on each of the first and second clutch wheels is an even number fraction of the number of sprockets on the feed wheel.

28. The feed mechanism of claim 27 wherein each of the first and second clutch wheels includes six ratchets.

* * * * *